United States Patent [19]

Fitzpatrick

[11] Patent Number: 4,572,984

[45] Date of Patent: Feb. 25, 1986

[54] BLUE LUMINESCENT CATHODE RAY TUBE DEVICE WITH IMPROVED COLOR FILTERING SYSTEM

[75] Inventor: Brian J. Fitzpatrick, Ossining, N.Y.

[73] Assignee: North American Philips Corporation, New York, N.Y.

[21] Appl. No.: 600,049

[22] Filed: Apr. 13, 1984

[51] Int. Cl.[4] ..... H01J 29/10

[52] U.S. Cl. ..... 313/467; 313/112; 313/478

[58] Field of Search ..... 313/478, 112, 467, 466; 358/253; 350/312, 418

[56] References Cited

U.S. PATENT DOCUMENTS 3,873,868 3/1975 Robinder ..... 313/112

FOREIGN PATENT DOCUMENTS 2098393A 11/1982 United Kingdom ..... 313/478

*Primary Examiner*—Robert Yoncoskie

*Attorney, Agent, or Firm*—Norman N. Spain

[57] ABSTRACT

The invention relates to a cathode ray tube device for generating a bright blue light of the type that is particularly useful for projection color television and information display. To filter out undesired radiation emitted by a silver-activated zinc sulfide phosphor, there is located in the path of blue radiation a concentrated solution of a soluble erbium salt and Methyl Violet 2B.

14 Claims, 2 Drawing Figures

BLUE LUMINESCENT CATHODE RAY TUBE DEVICE WITH IMPROVED COLOR FILTERING SYSTEM

BACKGROUND OF THE INVENTION

This invention relates to a new novel CRT device for generating a bright blue light spot of the type that is particularly useful for projection color television and information display.

Blue light radiation for use in projection color television generally is produced by the electronic bombardment of a blue luminescent zinc sulfide phosphor, for example a silver-activated zinc sulfide phosphor (P-22 blue). This phosphor, when excited by electronic bombardment produces a high amount of the desired radiation at 460 nm as well as significant amounts of undesired radiation in the 432–500 nm zone surrounding the desired main peak at 460 nm.

As part of this undesired radition is in the green zone, there is some dilution of the desired blue radiation. Further due to the presence of the high degree of radiation surrounding the desired frequency at 460 nm blurring of the image may occur when the 460 nm radiation image is brought into focus, due to the chromatic abberation of the lens system.

Various means have been proposed for filtering out the undesired radiation for color television tubes. For example, Denki, Japanese Pat. No. 57-180859 shows the use of a glass filter plate containing $Nd_2O_3$ and a small amount of either $Cr_2O_3$ or $Pr_2O_3$. Seward et al U.S. Pat. No. 4,086,089 employs glass faceplates for color television tubes which faceplates function as filters. These faceplates contain $Na_2O$, AgHal and $SiO_2$. In addition, Dutch Octrooi 144063 shows a solid optical filter employing a lanthanum salt or oxide. However, none of these patents show a filtering means capable of substantially reducing the undesired radiation or wings surrounding the desired 460 nm radiation produced in a cathode ray tube containing a silver-activated zinc sulfide phosphor without significantly reducing the 460 nm radiation.

BRIEF SUMMARY OF THE INVENTION

A principal object of this invention is to provide a cathode-ray tube (CRT) device for generating a brilliant blue light spot in which a silver-activated zinc sulfide phosphor is employed and there is a significant reduction in the radiation from undesired areas surrounding the desired radiation 460 nm and no significant suppression of the desired radiation at 460 nm.

Another object of this invention is to provide an externally liquid cooled CRT device for generating a bright blue light spot for projection television and information displays in which a silver-activated zinc sulfide luminescent material is employed and troublesome radiation in the 440 to 450 nm region, and in the 470 to 540 nm region, are suppressed without significant reduction in the desired radiation at 460 nm.

These and other objects of the invention will be apparent from the description as follows.

According to the invention the applicant has developed a new and novel CRT device for generating a bright blue light spot employing a silver-activated zinc sulfide capable of emitting blue radiation when excited by electrons and in which device, there is positioned outside of the faceplate of the tube envelope of the CR tube and in the path of the blue radiation, a transparent light filtering means comprising a concentrated solution of a soluble erbium salt and Methyl Violet 2B. Quite unexpectedly it is found that light emitted from the CRT device of this invention has drastically reduced radiation in the 440–450 nm region and the 470–540 nm region with practically no decrease in the desired radiation peak at 460 nm.

DETAILED DESCRIPTION OF THE PREFERRED EMBODIMENTS

As the filtering solution of the invention any concentrated solution containing a soluble erbium salt and Methyl Violet 2B may be employed. However, the solution preferably contains 20 to 40 percent by weight of the erbium salt and 0.0004 to 0.0008 percent by weight of the voilet 2B.

It has been found that the most useful solutions occur in the range wherein the concentration of the erbium salt is from 25 to 30 by weight and the concentration of the Methyl Violet 2B is from 0.0005 to 0.0007 by weight.

As a solvent, a combination of water and alcohol may be employed. Examples of alcohols that may be employed are ethylene glycol, 1,2-propylene glycol, 1,3-propylene glycol, glycerol, ethanol, propanol, isopropanol, and methanol.

Preferably up to 80% by weight of the solvent consists of the alcohol. In such a case the solution may also serve as an excellent coolant for the tube during operation while at the same time the solution is resistant to freezing during storage.

Most preferable the solvent consists of 50% by weight of ethylene glycol and 50% by weight of water. If the solution not only is to serve to suppress the undesired radiation but also as a coolant for the tube, it is preferred that the solution be carried on the external surface of the faceplate of the tube and be held in place by a glass plate or other transparent member sealed to the external surface of the faceplate. However, if no cooling effect is desired the solution need not be carried directly on the surface of the faceplate of the CRT tube but may be contained in a separate container outside of the external surface of the faceplate as long as the container is in the path of the radiation emitting from the tube and is transparent to the radiation from the tube.

Preferably the index of refraction of the container matches that of the faceplate.

Any water soluble erbium salt may be employed, examples of which are erbium chloride, erbium iodide, erbium bromide and erbium nitrate. Of these, the erbium nitrate salt is preferred.

The silver-doped zinc sulfide phosphor (P22 blue) which is the blue radiating phosphor used most frequently in commercially available CRT devices is described in "Optical Characteristics of Cathode Ray Tube Screens", (December, 1980) Electronic Industries Association, Washington, D.C. The phosphor material may be present in a cathode ray tube as a luminescent screen coated on the inner surface of the faceplate but may also be in form of a single self-supporting crystal only the surface of which is activated.

Figure 1:
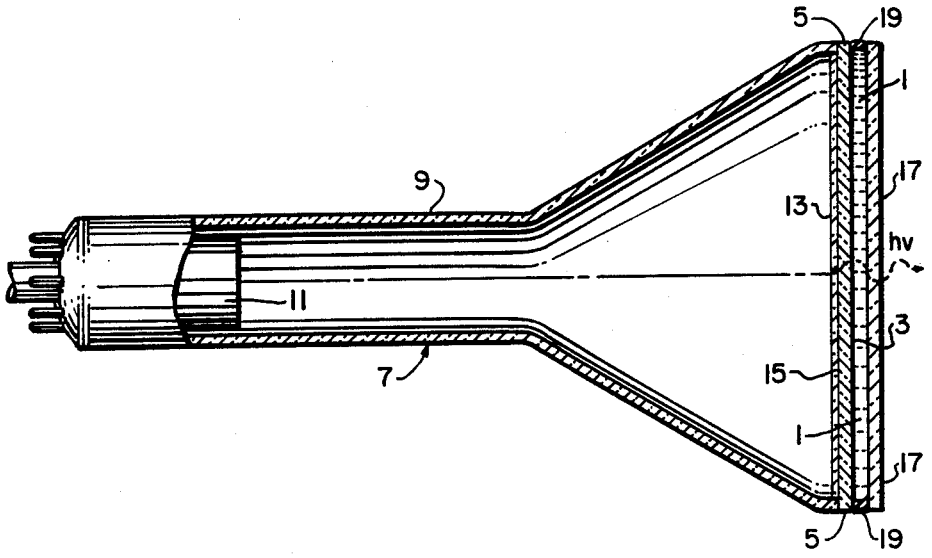
FIG. 1 is a cross-sectional view of a CRT device of the invention.

For a more complete understanding of the invention, the invention will now be described in greater detail with reference to FIG. 1 of the drawing which is a cross-sectional view of a preferred embodiment of the CRT device of the invention.

A solution of 12 g of $Er(NO_3)_3.5H_2O+0.2$ mg Methyl Violet 2B in 21 ml of 50% $H_2O$:50% ethylene glycol was made up. An 0.5 cm thick layer of the resultant light filtering solution 1 was prepared and applied to the external surface 3 of the glass plate 5 of a cathode ray tube 7 supplied with envelope 9 and containing an electron gun 11 positioned to emit a beam of electrons impinging the surface of a blue fluorescent luminescent screen 13 formed of a silver-activated zinc sulfide phosphor (P-22 blue) deposited on the internal surface 15 of the faceplate 5. The solution layer 1 is held in place on the external surface 3 of the faceplate 5 by transparent cover plate 17 and seals 19.

Figure 2:
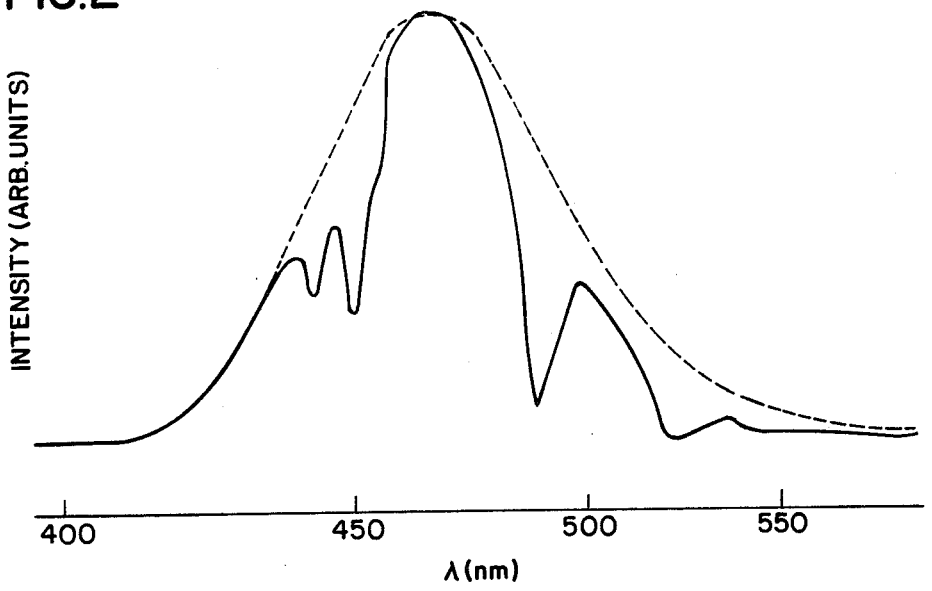
FIG. 2 is a graph showing the spectral energy distribution of the radiation emitted from a CRT device of the invention in the range of 400–540 nm and the spectral energy distribution of the radiation emitted from an identical CRT device without the light filtering means of the invention.

The light output of this CRT device upon excitation of the luminescent screen by an impinging electron beam was scanned with a monocrometer in the wavelength range of 400 to 600 nm to record the result as is shown in the unbroken line curve in the graph of FIG. 2 of the drawing in which the wavelength in nm is plotted on the abscissa and the measured intensity in arbitrary units is plotted on the ordinate. In similar fashion the light output produced by the identical CRT device except for the omission of the erbium salt and the Methyl Violet 2B from the cooling solution was scanned in the same wavelength range. The recorded result is shown in the broken line curve in the graph of FIG. 2 of the drawing.

As inspection of results shown in FIG. 2 of the drawing shows that the use of the filtering solution containing the erbium salt and the Methyl Violet 2B results in a significant decrease in undesired radiation from the device particularly undesired radiation from 440 to 450 nm and 470 to 540 nm while leaving the level of the desired 460 nm radiation peak virtually unchanged.

While the present invention has been described with reference to particular embodiments thereof, it will be understood that numerous modifications can be made by those familiar with the state of the art without actually departing from the scope of the invention.

What I claim is:

1. A cathode-ray tube device for generating a bright blue light spot comprising:

a cathode-ray tube including an evacuated envelope with a face plate; means, located within said envelope, to generate an electronic beam; a silver-activated zinc sulfide phosphor, which emits blue radiation when excited by electrons from said electronic beam and located within said envelope; and in which device there is positioned outside of the external surface of said face plate and in the path of said blue radiation, a light beam filtering means comprising a container, which at least in the path of said blue radiation is transparent to said radiation, containing a concentrated solution of a soluble erbium salt and Methyl Violet 2B.

2. The cathode-ray tube device of claim 1 wherein the solution contains a solvent which is a mixture of water and an alcohol selected from the group consisting of ethylene glycol, 1,2-propylene glycol, 1,3-propylene glycol, glycerol, methanol, ethanol, propanol, isopropanol and benzyl alcohol, and mixtures thereof.

3. The cathode-ray tube device of claim 2 wherein the erbium salt is selected from the group consisting of erbium chloride, erbium bromide, erbium iodide and erbium nitrate.

4. The cathode-ray tube device of claim 3 wherein the solution contains from 20% to 40% by weight of the erbium salt and 0.0004% to 0.0008% by weight of the Methyl Violet 2B.

5. The cathode-ray tube device of claim 2 wherein the solvent is a mixture of water and up to 80% by weight of ethylene glycol.

6. The cathode-ray tube device of claim 3 wherein the solvent is a mixture of water and up to 80% by weight of ethylene glycol.

7. The cathode-ray tube device of claim 4 wherein the solvent is a mixture of water and up to 80% by weight of ethylene glycol.

8. The cathode-ray tube device of claim 6 wherein the erbium salt is erbium nitrate.

9. The cathode-ray tube device of claim 7 wherein the erbium salt is erbium nitrate.

10. The cathode-ray tube device of claim 9 wherein the solution contains about 28% by weight of erbium nitrate and about 0.0006 by weight of Methyl Violet 2B in a 50% water-50% ethylene glycol solution.

11. The cathode-ray tube device of claim 1 wherein the light filtering means is sealed to the outer surface of the face plate.

12. The cathode-ray tube device of claim 2 wherein the light filtering means is sealed to the outer surface of the face plate.

13. The cathode-ray tube device of claim 8 wherein the light filtering means is sealed to the outer surface of the face plate.

14. The cathode-ray tube device of claim 10 wherein the light filtering means is sealed to the outer surface of the face plate.

* * * * *